US008459267B2

(12) United States Patent
Zimmerman

(10) Patent No.: US 8,459,267 B2
(45) Date of Patent: Jun. 11, 2013

(54) MOUTHGUARD AND METHOD OF MANUFACTURE THEREFOR

(76) Inventor: Edgar S. Zimmerman, Las Vegas, NV (US)

( * ) Notice: Subject to any disclaimer, the term of this patent is extended or adjusted under 35 U.S.C. 154(b) by 62 days.

(21) Appl. No.: 13/156,231

(22) Filed: Jun. 8, 2011

(65) Prior Publication Data

US 2012/0312309 A1 Dec. 13, 2012

(51) Int. Cl.
*A61C 5/14* (2006.01)

(52) U.S. Cl.
USPC ..... 128/861

(58) Field of Classification Search
USPC ..... 128/848, 859, 861–862; 433/6; 602/902
See application file for complete search history.

(56) References Cited

U.S. PATENT DOCUMENTS

| | | | | |
|---|---|---|---|---|
| 2,643,652 | A | 6/1953 | Cathcart | |
| 2,996,908 | A | 1/1961 | Cathcart et al. | |
| 3,016,052 | A | 1/1962 | Zubren | |
| 3,457,916 | A | 7/1969 | Wolicki | |
| 3,473,225 | A * | 10/1969 | Walker et al. | 433/48 |
| 3,496,936 | A | 2/1970 | Gores | |
| 3,518,988 | A | 7/1970 | Gores | |
| 3,864,832 | A | 2/1975 | Carlson | |
| 4,044,762 | A | 8/1977 | Jacobs | |
| 4,185,817 | A | 1/1980 | Peterson | |
| 4,337,765 | A * | 7/1982 | Zimmerman | 128/861 |
| 5,460,527 | A * | 10/1995 | Kittelsen | 433/215 |
| 7,156,774 | B2 * | 1/2007 | Mohindra | 482/11 |
| 7,328,706 | B2 * | 2/2008 | Bardach et al. | 128/861 |

OTHER PUBLICATIONS

"Reduction of Stress in the Chewing Mechanism—Part III" by W. B. May, D.D.S., Basal Facts, vol. 3, No. 1, pp. 22-28, Jul. 1978.

* cited by examiner

*Primary Examiner* — Patricia Bianco
*Assistant Examiner* — Camtu Nguyen
(74) *Attorney, Agent, or Firm* — Weide & Miller, Ltd.

(57) ABSTRACT

An improved mouthguard provides shock absorption for the jaw, teeth, and head to reduce the risk of injury when a user encounters a blow to the jaw. The improved mouthguard may comprise a generally U-shaped body having upwardly extending flanges which surround the arch of a user's teeth. An anterior section of the U-shaped body may have padding integrated therein to protect the front teeth. Posterior sections of the U-shaped body may have a thickened portion having one or more adjacent perforations or openings to increase shock absorption. The improved mouthguard may also have an inner layer of material configured to form impressions of the user's teeth to provide a custom fitting mouthguard. The inner layer and U-shaped body may be formed with a similar or the same curing process such that the inner layer and U-shaped body are permanently bonded together as the inner layer sets.

20 Claims, 4 Drawing Sheets

MOUTHGUARD AND METHOD OF MANUFACTURE THEREFOR

BACKGROUND OF THE INVENTION

1. Field of the Invention

The invention relates generally to protective mouthpieces, and in particular to an improved mouthguard capable of being customized for particular users and a method of manufacturing the improved mouthguard.

2. Related Art

There are a number of different types of mouthguards presently available on the market but they have deficiencies which prevent their giving optimum protection to the wearer against serious injuries to the teeth and particularly to the head and neck area.

For example, many mouthguards consist simply of U-shaped trough-like members of resilient material, such as rubber or suitable plastic, shaped to fit over the upper or lower teeth or both. In the case of many such mouthguards, a blow to the lower jaw may result in one or more teeth penetrating through the mouthguard structure and, more importantly, such mouthguards provide little, if any, protection against head and neck injuries.

One prior art mouthguard is formed to provide a bottom wall which increases in thickness from the posterior to the anterior area, this increase in thickness being such as to conform to the normal angle of approach of the upper and lower jaws in the act of closing the mouth and thereby to ensure engagement of the mouthguard by the incisors of the lower jaw simultaneously with the molars thereof. Because of the construction and hinging of the lower jaw, the movement of the forward portion thereof relative to the rear portion during opening and closing of the mouth is approximately a three-to-one ratio. This prior art structure is apparently intended to have a gradually increasing thickness toward the forward portion so as to correspond generally to this ratio and to thereby provide an even distribution of contact over all the teeth. As will be explained later in describing the invention of the present application, this even distribution of contact cannot accomplish the beneficial results of the applicant's invention.

Another prior art structure involves a mouthpiece with a triangular-shaped ridge depending from the lower wall thereof in the molar-bicuspid area. In this structure, the depending ridge has a relatively sharp edge which is intended to engage the lower teeth in the central area between the buccal and lingual cusps, that is, in the fossa of the lower teeth. In the case of this structure, as the triangular ridge is compressed as a result of a blow to the lower jaw, it spreads somewhat against the sides of the cusps, creating an undesirable lateral force. Moreover, in the case of many individuals, the teeth are not in direct line and the straight edge of the ridge in that case would engage not the fossa but the inner or outer inclined walls of the cusps, depending on the direction of misalignment of each individual tooth, again creating undesirable lateral force and defeating the purpose of the mouthguard.

Normally, the head of the condyle of the mandible articulates with a cartilagenous disk or movable cartilagenous pad in the temporomandibular joint, and it is this pad which glides between the condylar head of the mandible and the articular surface of the glenoid fossa of the temporal bone. In wearing conventional mouthguards, the athlete is not only subject to potential damage to the teeth but, more importantly, to damage resulting from direct transmittal of force through the mandible, the thin layer of cartilage, and into the temporal bone and the cranial cavity. Substantial increases in intracranial pressure and cranial bone deformation have been shown to occur when a football player, for example, receives a blow on the chin or on the faceguard of the protective helmet. This results in a measurable deformation of the skull. Similar damage occurs in other contact sports, such as, boxing, hockey, soccer, lacrosse, etc. Because of the use of protective helmets with faceguards for intercepting horizontal blows, the principal injuries to football players in the head area result from upward blows to the lower jaw, especially the chin area, and upward blows to the faceguard which transmit force to the jaw through the chin strap.

By the present invention these limitations and deficiencies of the prior art mouthguards have been overcome and not only is protection provided against damage to the teeth, but the mouthguard is constructed so as to reduce or avoid transmission of damaging force from the condyle of the mandible to the temporal bone and the cranium.

From the discussion that follows, it will become apparent that the present invention addresses the deficiencies associated with the prior art while providing numerous additional advantages and benefits not contemplated or possible with prior art constructions.

SUMMARY OF THE INVENTION

An improved mouthguard is disclosed herein. The improved mouthguard provides increased shock absorption at the posterior section of the user's teeth. In general, the improved mouthguard utilizes a thickened portion having a set of perforations or openings therein to increase shock absorption. The components of the improved mouthguard may be cured in a particular way so as to allow them to readily bond together. This is advantageous in that a deformable inner layer may be provided to form an impression of the user's teeth to thereby customize the mouthguard to the user. Once an impression is formed, the inner layer may be allowed to set. The curing process used to form the components of the improved mouthguard cause the inner layer to readily and permanently bond to the remainder of the mouthguard without the need for separate adhesives and while allowing the mouthguard to remain flexible and resilient.

The improved mouthguard may have various configurations. In one exemplary embodiment for example, the mouthguard may comprise a bottom wall formed of a resilient material and having an approximate U-shape corresponding generally to the shape of the arch of the upper jaw. The bottom wall may have a bottom surface substantially flat laterally and being of greater width than the width of the lower teeth so as to extend laterally across the full width of the lower teeth.

A plurality of spaced inner and outer flanges may extend upwardly from the bottom wall forming a cavity for receiving the upper teeth. A portion of greater thickness may extend downward from the bottom wall across the length of each molar-bicuspid region. The portion of greater thickness may be formed in an anterior-posterior direction to have an even surface curved in the anterior-posterior direction at each the molar-bicuspid region. Also or alternatively, the portion of greater thickness may extend from the first bicuspid to the second molar. The portion of greater thickness may have its maximum thickness in the area which engages the lower first molar A plurality of adjacent openings may extend from a top surface of the bottom wall and downward into a section of each portion of greater thickness. The plurality of adjacent openings are generally configured to absorb shock resulting from a blow to the lower jaw by collapsing as force is applied to them. It is noted that each plurality of adjacent openings may be arranged in a circular shape at the bottom wall. In addition the plurality of adjacent openings may extend into but not through each portion of greater thickness.

It is contemplated that a labial incisor area of the mouthguard may have padding extending approximately between the cuspids of the upper jaw integrally formed therein to protect the front teeth. The padding may comprise a multi-cavity lumen or an elongated foam member extending approximately between the left and right cuspid of the upper jaw.

An inner layer may be bonded to at least a portion the bottom wall and the plurality of spaced inner and outer flanges. The inner layer may be configured to conform to the shape of the teeth of the upper jaw and to close an open end of the plurality of adjacent openings at the top surface of the bottom wall. The inner layer and the bottom wall and inner and outer flanges may all be formed using the same curing process to allow the inner layer to form a permanent bond to the bottom wall and the inner and outer flanges. For instance, the inner layer and the bottom wall and inner and outer flanges may be formed using a platinum silicone curing process to allow the inner layer to form a permanent bond to the bottom wall and the inner and outer flanges.

Various methods of protecting users with an improved mouthguard are provided herein as well. For example, in one embodiment a method of protecting the teeth and head from injury with an improved mouthguard comprises providing an approximately U-shaped body of resilient material having a bottom wall and spaced inner and outer flanges forming an upwardly directed cavity conforming generally to the shape of the arch of the upper jaw. The bottom wall may be formed in an anterior-posterior direction to include over the length of each molar-bicuspid region a portion of greater thickness than the remainder of the bottom wall.

One or more openings may extend downward from the bottom wall and into the portion of greater thickness to increase shock absorption at the portion of greater thickeness. The mouthguard may then be aligned with the upper jaw with the upper teeth received in an inner layer of material within the cavity. The inner layer of material may be formed to the upper teeth such that the inner layer of material holds impressions of the upper teeth therein. The lower jaw may then be closed until the thickened portions are engaged by the lower molar-bicuspid teeth.

The U-shaped body and the inner layer of material may be cured with the same silicone curing process to ensure a permanent bond is formed between the U-shaped body and the inner layer of material. It is noted that the inner layer of material may be inserted into the cavity and cover an open end of the one or more openings with the inner layer of material to enclose the one or more openings.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE PREFERRED EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Figure 1:
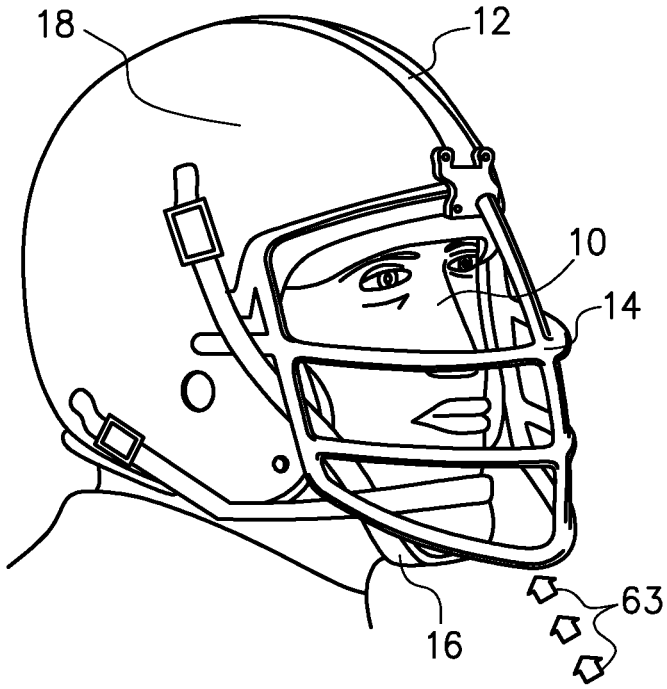
FIG. 1 is a view of a human head with a conventional football helmet thereon.

Referring first to FIG. 1, there is shown a representation of a human head 10 with a conventional football helmet 12 thereon. The helmet includes a protective cage or faceguard 14 for protecting the facial area and a chin strap 16 for holding the helmet in place. Despite the protective aspects of the conventional helmet, a blow to the chin or to the chin strap area or an upward blow to the faceguard is still capable of causing significant damage, not only to the teeth, but to the cranial area indicated generally at 18.

Figure 2:
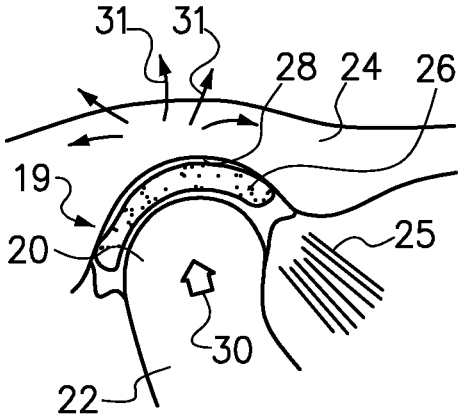
FIG. 2 is an enlarged view of the temporomandibular joint area, illustrating the application of force thereto.

The nature of the potential damage associated with such blows to the chin or faceguard area can be better appreciated by reference to FIG. 2. This figure illustrates the temporomandibular joint 19 formed between the condyle 20 of the mandible or lower jaw 22 and the temporal bone 24, the movement at the lower jaw being controlled by muscles shown generally at 25. A cartilagenous disk or pad 26 is disposed between the condyle and the glenoid fossa 28 of the temporal bone. The head of the condyle 20 articulates with the cartilagenous disk or pad 26 in the temporomandibular joint and the cartilagenous disk or pad 26 glides between the condylar head of the mandible and the articular surface of the glenoid fossa of the temporal bone. With conventional mouthguards, the components of the temporomandibular joint are positioned as shown in FIG. 2. Under these circumstances a blow to the chin or upward blow to the faceguard causes a transmission of force in the direction of the arrow 30 into the temporomandibular joint and through the temporal bone into the cranial area, as generally indicated by the arrows 31. This not only causes potential damage to the joint itself but the force is transmitted to the cranium resulting in potential deformation in the cranial area indicated at 18 and damage to the brain, for example, concussion.

Figure 3:
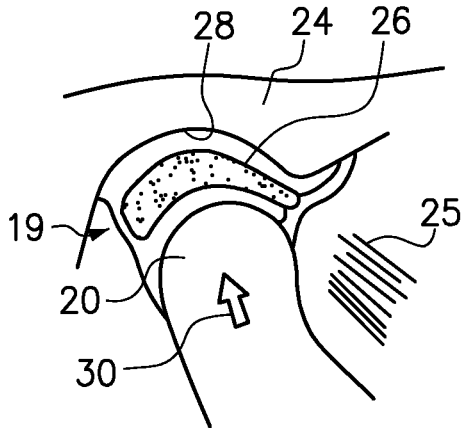
FIG. 3 is a view similar to FIG. 2 but illustrating the temporomandibular joint as affected by the mouthguard of this invention.

The improved mouthguard, as described in detail below, tends to not only cause a separation of the condyle 20 of the mandible relative to the temporal bone 24 as illustrated in FIG. 3, but also provide improved shock absorption for the temporomandibular joint and cranial area. Thus, when a blow is received to the chin or faceguard with the improved mouthguard in place, any force in the direction of the arrow 30 has a significantly less damaging effect on the temporomandibular joint 19. Moreover, the separation and shock absorption provided by the improved mouthguard of the bony parts of the temporomandibular joint, namely the condyle of the mandible and the temporal bone, prevents a damaging shock wave from being transmitted through the temporomandibular joint 19 to the brain and other underlying structures in the cranial area. Further, as will be explained in detail below, because of the construction of the mouthguard of this invention, such a blow tends to cause a greater rather than lesser separation at the temporomandibular joint 19 and thereby further reduces the potential damage.

Figure 4:
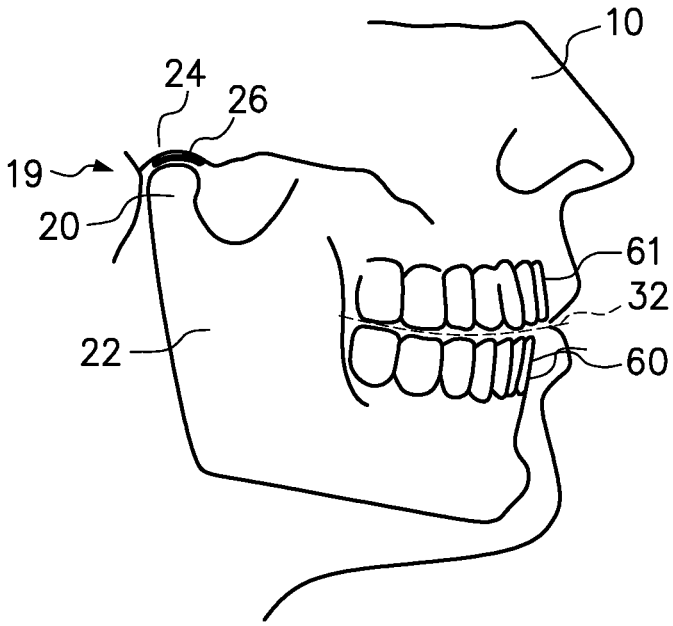
FIG. 4 is a profile view of a human head illustrating the general position of the teeth and of the temporomandibular joint.

Referring now to FIG. 4, there is shown an illustration of a portion of a human head 10 with sections broken away to illustrate the teeth and temporomandibular joint area. The dashed line 32 shown in FIG. 4 indicates the Curve of Spee which is a line generally extending between the upper and lower dental arches. The relationship of the components of the temporomandibular joint 19 shown in FIG. 4 correspond to those shown in enlarged form in FIG. 2.

Figure 5:
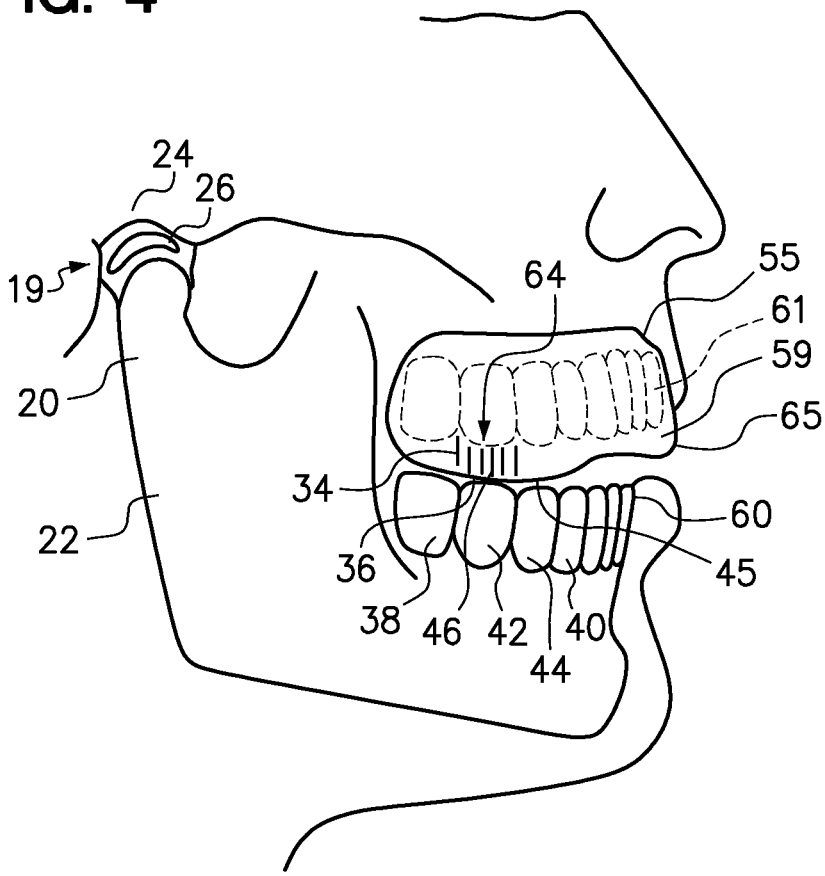
FIG. 5 is a view similar to FIG. 4 but showing the mouthguard of this invention and the different relationships resulting therefrom.

Turning now to FIG. 5, there is shown a view similar to FIG. 4 but with the improved mouthguard 34 of this invention shown superimposed on the upper teeth. It is noted that though described below with regard to the upper teeth, the improved mouthguard 34 may be worn on and/or configured for the lower teeth. The improved mouthguard 34 has a bottom wall of increased thickness in the region indicated at 36. Specifically, this greater thickness is in the region extending from the second molar 38 through the first bicuspid 40 and including the first molar 42 and the second bicuspid 44, that is, the portion of greater thickness extends in an anterior-posterior direction. Viewed laterally, the thickness is constant, that is, whatever the thickness is in a given tooth area, it is the same from the buccal side of the improved mouthguard to the lingual side. The lower surface 45 of the thicker portion 36 of the bottom wall 48 is shaped to follow approximately the Curve of Spee, but the bottom wall has its maximum thickness in the area positioned to contact the lower first molar. As shown in FIG. 5, as the jaw closes to the position there illustrated, the improved mouthguard initially contacts the lower teeth generally in the area of the lower first molar, as indicated by the numeral 46, and the lower jaw tends to pivot about this area 46 as the mouth is closed. It can be seen by reference to FIG. 5 that with this mouthguard construction, when the lower jaw has almost reached its closed position, the aforementioned pivoting effect has resulted in a slight separation in the area of the temporomandibular joint 19. This separation is shown in greater detail in the enlarged view of FIG. 3.

FIG. 5 also shows that the thicker portion 36 of the bottom wall 48 may have one or more perforations 64, bores, or openings therein. As will be described in further detail below, these perforations 64 may extend downward from a bottom wall 48 and into the thicker portion 36. The perforations 64 may be arranged in concentric circles (or other concentric or non-concentric shapes) to improve shock absorption, as will be described below. In one or more embodiments, the perforations 64 may not extend all the way through the thicker portion 36 such as shown. This helps prevent dirt and debris or other unwanted material from entering, developing or accumulating within the perforations 64.

In general, the perforations 64 provide improved shock absorption between the upper and lower teeth thus improving protection to the temporomandibular joint 19 and cranial area. To illustrate, as the lower teeth are forced toward the upper teeth (such as due to a blow), the perforations 64 collapse vertically as well as laterally. This catches the lower teeth and cushions the force as the lower teeth approach the upper teeth. The force of the lower teeth is thus distributed vertically as well as laterally by the perforations 64. This results in improved shock absorption.

The perforations 64 therefore provide a "bushing" type action where, when force is applied, the intensity of the force is diminished because the perforations absorb the force by being squeezed together or collapsing laterally while being compressed vertically.

Figure 6:
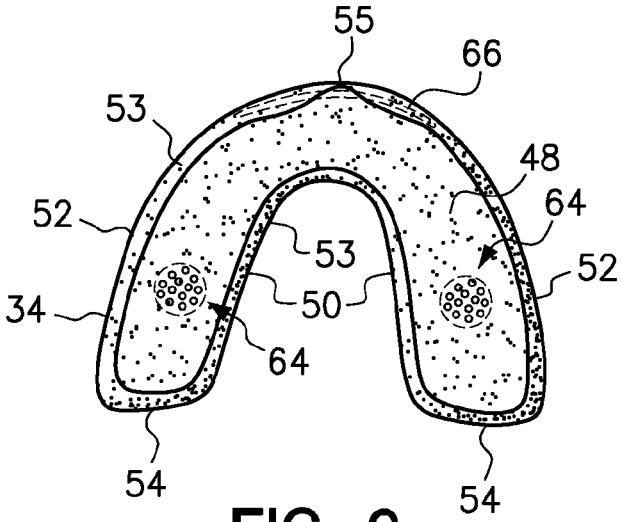
FIG. 6 is a plan view of the mouthguard of this invention.
Figure 7:
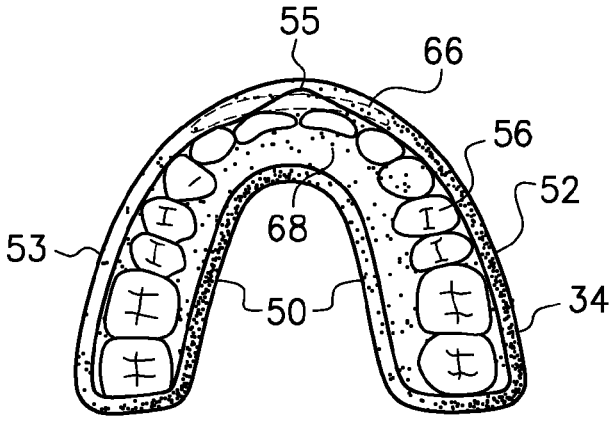
FIG. 7 is a view similar to FIG. 6 but showing impressions of the upper teeth therein.
Figure 8:
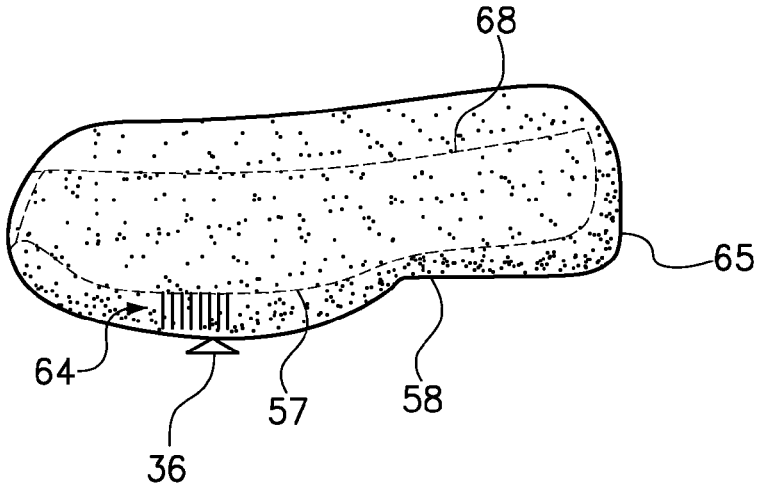
FIG. 8 is a side view of the mouthguard of this invention.

The improved mouthguard 34 of this invention is shown in greater detail in FIGS. 6, 7 and 8. Referring now to these figures, the improved mouthguard 34 is formed in an approximately U-shape corresponding generally to the shape of the dental arch of the upper jaw. The improved mouthguard 34 has a substantially U-shaped cross section and includes a bottom wall 48, an inner or lingual flange 50 extending upwardly from the bottom wall, and an outer or buccal flange 52 also extending upwardly from the bottom wall. The inner and outer flanges 50 and 52, respectively, are intended to conform generally to the lingual and buccal areas, respectively, of the upper teeth and gums, and each of the flanges end in a rounded edge 53 approximating the gingival tissues. The flanges 50 and 52 are connected at their posterior ends by transverse flanges 54. The buccal flange 52 is notched downwardly, as indicated at 55, to provide space for the superior labial frenum. The bottom wall 48 is generally flat in a lateral direction and is of greater width than the width of the lower teeth so as to extend fully across the surface of the lower teeth and slightly beyond these teeth on both the lingual side and the buccal side. This insures that the bottom wall engages both the lingual and buccal cusps of the molars and bicuspids. Moreover, the bottom wall is of such width as to contact the lower teeth across both the lingual and buccal sides even where there is variation in the width of the dental arch, or misalignment, as is often the case, of these lower teeth. This can be visualized from FIG. 7. Although this figure shows the impressions 56 of the upper teeth in the improved mouthguard 34 rather than showing the lower teeth, the lower teeth are slightly inward of the upper teeth (the lingual cusps of the upper molars, for example, normally engage the fossa of the lower molars), and it can be visualized from FIG. 7 that the lower teeth would fall within the area of the bottom wall 48 of the improved mouthguard 34.

The side view of the improved mouthguard 34 shown in FIG. 8 further illustrates the construction of the improved mouthguard of this invention. As there shown, particularly by reference to the dashed line 57 which indicates the inner bottom surface of the cavity of the improved mouthguard, the bottom wall 48 has a portion of greater thickness in the thicker portion 36 which, as explained in connection with FIG. 5, may extend from the second molar 38 through the first bicuspid 40.

FIG. 8 also illustrates the construction of the perforations 64 present in the thicker portion 36. As can be seen, the perforations 64 may be openings that extend from or start at the top of the bottom wall, as indicated by dashed line 57, of the thicker portion 36 and continue downward toward the exterior bottom surface of the thicker portion 36. Typically, the perforations 64 will not extend out of the exterior bottom surface thus giving the perforations 64 a closed bottom end, such as shown. This ensures that at least some material will be between the upper teeth and the perforations 64 and also provides connecting structures which hold the perforations 64 in position relative to one another.

It is contemplated that some or all of the perforations may have a length of between 4-6 mm, though other lengths are contemplated. This allows the thicker portion 36 to be sized to fit within mouths of a variety of sizes, while allowing at least some material (preferably about 1 mm of material) to be between the inner bottom surface and the perforations 64. The thicker portion 36 may have increased thickness, such as 6-7 mm, or 8 mm to accept perforations 64 of various lengths. In one or more embodiments, a minimum of 1 to 1.5 millimeters of material may be between the inner bottom surface as indicated by dashed line 57 and the perforations 64.

Forward of the thicker portion 36, the bottom of the improved mouthguard 34 is recessed or offset upwardly, as indicated at 58, so as to provide a space 59 between the anterior portion of the improved mouthguard 34 and the lower incisors 60. As indicated by the dashed line 57, the bottom wall of the improved mouthguard 34 is of reduced thickness in the region 58. This recessed portion accomplished several functions. First, it allows a pivoting of the lower jaw about the fulcrum area indicated at 46 in FIG. 5 so as to provide a slight separation in the temporomandibular joint area. Secondly, it minimizes the possibility of damage to the upper incisors 61 and the lower incisors 60 in the event of a blow to the chin. Finally, it provides an assured breathing area when the mouthguard is in place, making the mouthguard more comfortable to wear, and also making it easier to speak clearly with the mouthguard in place.

Though various dimensions are contemplated, in one specific embodiment of the mouthguard of this invention, the thickness of the bottom wall 48 may be approximately 5-8 millimeters at the region 46 which is positioned to be engaged by the lower first molar. The portion of the mouthguard bottom wall extending posteriorly from the region 46 may be approximately 4-5 millimeters thick and the portion extending anteriorly to and including the area of the lower first bicuspid may also be approximately 4-5 millimeters thick. The recessed portion at 58 may be approximately 2-3 millimeters thick. The front labial incisor area 65 may be thickened as well. For example, as shown, this area 65 may be enlarged and/or squared or rounded off such as by including additional silicone (or other material). This area may be 4-5 millimeters thick in one or more embodiments.

Referring to FIG. 7, it can be seen that a different silicone material may be blended or formed into the labial incisor area 65 to form additional padding 66 at the anterior of the improved mouthguard. This material may have a different durometer or have other characteristics that distinguish it from other portions of the mouthguard. The purpose of this material would be to provide further protection against forces or blows that occur to the area near and between the user's cuspids. The padding 66 may be formed into the labial incisor area 65 without interfering with the groove for the superior labial frenum. In one or more embodiments, the padding 66 may extend horizontally from the left cuspid to the right cuspid to protect the incisor teeth between the upper right and left cuspid teeth.

It is contemplated that the padding 66 may also or alternatively be formed from a multi-cavity lumen made from silicone or other flexible material that is encapsulated at the labial incisor area 65. The padding 66 may be at least 1 mm in diameter, and between 2-3 millimeters in maximum diameter. The padding 66 could also or alternatively be formed from foam tubing or an elongated member made from silicone or other flexible material. For example, a full or half round foam member may be used to form padding 66.

The added protection at the labial incisor area 66 adjacent and between the user's cuspids is beneficial especially in competitive sports where elbows, knees, heads, etc. . . . may strike the mouth. The added protection helps prevent fracture of the incisor teeth.

FIG. 6 provides a top view of the improved mouthguard 34 that provides a top view of the perforations 64. As can be seen, there may be a plurality of perforations 64 on either side of the improved mouthguard 34. The perforations 64 may be positioned at the thicker portion 36 of the improved mouthguard 34 such as described above. FIG. 6 also illustrates an exemplary circular arrangement of perforations 64. The area in which the perforations 64 are located may be various sizes. For example, in one embodiment, the perforations 64 may be within a 10 millimeter area. Larger or smaller areas are also possible.

Though the perforations 64 are shown centered or positioned near or around a central area of the thicker portion 36, it is contemplated that perforations may be in various locations. For example, perforations 64 may be adjacent the highest or tallest tooth or teeth to provide shock absorption where it is most likely needed. Alternatively or in addition, perforations may be at the thickest part of the thicker portion 36, or at thinner portions such as to improve shock absorption at these locations.

The perforations 64 need not be arranged in circular shapes such as that shown in FIG. 6. For example, the perforations 64 may be arranged in elongated configurations of various shapes, including rectangular, polygonal, or tapered shapes. The density or number of perforations 64 for a particular area may be increased or decreased to adjust the level of shock absorption. For example, additional perforations 64 may make an area softer while fewer perforations may make an area harder. It is contemplated that the size of the perforations 64 may be increased or decreased as well to alter the level of shock absorption. Typically, the perforations 64 will be round or circular in shape but may be rectangular, polygonal, or other shapes.

In one specific embodiment, the perforations 64, may be in a 10 millimeter circular area, such as shown. The perforations 64 themselves may be less than 1 millimeter in diameter. In other embodiments, the perforations 64 may be 1 millimeter or larger however.

The effectiveness of the improved mouthguard in minimizing injury will be more clear by observing its operation when positioned properly in the mouth about the upper teeth, referring primarily to FIGS. 2, 3, 4 and 5. As indicated previously the lower surface 45 of the thicker portion 36 of the improved mouthguard is shaped to follow approximately the Curve of Spee, that is, a line generally following the line of occlusion between the upper and lower teeth, but the bottom wall 48 has its maximum thickness in the area 46 positioned to contact the lower first molar. When the lower jaw is closed, the lower teeth engage the thicker portion 36 of the improved mouthguard approximately at the first molar, as indicated by the numeral 46 in FIG. 5. Thereafter, as the lower jaw completes its closure, it tends to pivot about the fulcrum provided at the area 46, thereby effecting a slight separation in the temporomandibular joint, as can best be seen by comparing FIGS. 4 and 5 or, on a larger scale, comparing FIGS. 2 and 3. Because the bottom wall 48 of the improved mouthguard is, as described previously, relatively flat laterally and of a width sufficient to extend laterally beyond the lower teeth both buccally and lingually, the force between the improved mouthguard and the lower teeth is distributed relatively evenly laterally over the molars and over the bicuspids and not concentrated on any limited area of each of these teeth. In accordance with this invention, however, the force is initially not evenly distributed anteriorly and posteriorly because of the initial contact at the fulcrum area 46 and the pivoting movement about this fulcrum.

Unlike prior art mouthguards, when an upward blow in the general direction of the arrows 63 in FIG. 2 is received on the chin or faceguard of an individual using the improved mouthguard of this invention, because of the aforementioned separation in the temporomandibular joint, the force of the blow does not result in the transmission of shock waves through the temporomandibular joint to the brain and cranial area 18. Because of the separation in the temporomandibular joint area, possible damage to the temporomandibular joint itself from such a blow is minimized. Moreover, because of the pivoting about the area 46, as previously described, a blow to the chin also tends to slightly increase the separation in the temporomandibular joint, further reducing the transmission of force to and through this joint. The thicker material in the region 36 acts as a cushion and helps absorb force transmitted in a vertical direction, that is, along the long axis of the ramus and condyle of the mandible. Even though under a strong upward blow the entire jaw may move upwardly as the lower teeth are pressed into and cushioned by the improved mouthguard, unlike prior art structures this upward movement does not result in the transmission of damaging force to and through the temporomandibular joint, because the aforementioned pivoting action counteracts this upward movement at the temporomandibular joint, and the separation between the condyle and the temporal bone is slightly increased rather than reduced under the impact of the blow.

In addition, the perforations 64 in the thicker portion 36 improve shock absorption at the crucial area between the user's teeth. This further reduces the transmission of shock to the user's jaw and cranium when the user is struck or otherwise is subject to a blow. The dissipation of energy by the perforations 64 improves protection of the jaw but also improves protection of the user's teeth in that the forces exerted and transmitted between the lower teeth and upper teeth is absorbed and dissipated by the perforations 64.

It is contemplated that the improved mouthguard may be custom-fitted. In such embodiments, the improved mouthguard may be made to conform to the upper dental arch of the prospective user and would include impressions 56 of the upper (or lower) teeth in the inside bottom wall of the improved mouthguard, as indicated in FIG. 7. The improved mouthguard could subsequently be installed in the correct position by the user with the upper teeth fitting in the previously-formed depressions. Traditionally, mouthguards have been made of a suitable material compatible with the oral tissues, for example a latex rubber or a synthetic plastic material of sufficient durability and density to maintain its form and function and having sufficient resiliency to provide the necessary cushioning effect. As will be described below, the improved mouthguard may be constructed from a silicon material that provides the desired cushioning effect while allowing a reliable two part construction that is highly beneficial in forming a custom fit to the user's teeth.

In custom-fitted embodiments, it is contemplated that the improved mouthguard may be made available in three sizes, small, medium and large, which should be sufficient to fit, with adequate accuracy, essentially all mouths. The selected sizes are based on comprehensive studies by the dental profession of jaw and dental arch shapes and sizes occurring in a substantial number of individuals adequately representative of the population as a whole.

In these embodiments of the invention, the improved mouthguard may be made of double-layered construction, including an outer shell of a material having the same characteristics as that of the unitary construction and an inner layer within the improved mouthguard made of moldable synthetic material which the user would mold to the hard and soft structures of the upper dental arch. FIG. 6 illustrates an exemplary outer shell. As can be seen, the outer shell may comprise a plurality of flanges 50,52,54 extending from a bottom wall 48. The outer shell may support one or more perforations 64 therein, such as in the thicker portion 36 of the outer shell, as discussed above. The outer shell may also serve as a structure to hold a lumen 66 or a distinct material at or within the front of the outer shell that improves shock absorption and protection of the teeth between and including the left and right cuspid.

An inner layer could be made of a material which is in a softened condition and which is caused to set after the impression is made. Also the inner layer could be made of a material which is soft enough to receive a proper impression but which then is caused to harden with the impression formed therein, by exposing it to air for a period of time. The inner layer may have a high viscosity, so as to be putty-like in one or more embodiments. Of course various viscosities may be used.

The user may custom fit the improved mouthguard by positioning inner layer over the upper teeth in the position shown in the drawings and mold it against the upper teeth and gums so that these teeth are impressed into the inner layer of material forming. The material of the inner layer would then be allowed to set in its final form. Thereafter, the improved mouthguard can be installed in the mouth for regular use with the upper teeth being received in the formed impressions and with the lower teeth received in formed impressions if these are formed during fitting.

Referring to FIG. 7 and FIG. 8, it can be seen that the outer shell may be used to hold the inner layer 68. The outer shell may also define the shape of the inner layer 68 where the inner layer meets the outer shell. It can also be seen, that the inner layer 68 may be inserted or applied to the outer shell and that the impressions 56 of one or more teeth may then be formed in the inner layer 68. The inner layer 68 may then be allowed to set or cure, making the impressions 56 permanent and bonding the inner layer 68 to the outer shell. It is contemplated that one or more adhesives could optionally be used to assist in this bonding.

In one preferred embodiment, the inner layer 68 and outer shell may be formed from compatible flexible shock absorbing materials. Though traditionally it has been difficult or impossible to reliably bond two separate flexible materials, such as silicones or other synthetic materials together, the improved mouthguard herein overcomes this drawback. In one preferred embodiment, the inner layer 68 and the outer shell may be formed from flexible materials cured in a similar or the same curing process. This is advantageous in that it allows two different flexible materials to bond to one another reliably.

For example, the improved mouthguard may have an outer shell formed from liquid silicone rubber and an inner layer formed from vinyl polysiloxane. It is noted that various medical grade silicone or other resilient materials may be used as well. The vinyl polysiloxane is beneficial in that it starts in a softened condition and thus is desirable for molding to a user's teeth. The liquid silicone rubber and vinyl polysiloxane may be cured using the same or a similar curing process, such as a platinum silicon curing process. This provides the unexpected benefit of allowing the vinyl polysiloxane to readily and permanently bond with the liquid silicone rubber as it sets. In this manner, the inner layer 68 adheres or integrates itself with the outer shell forming a complete improved mouthguard that is very rugged and reliable. By using a similar or the same curing process, the materials readily and permanently bond to one another even though they are flexible, without the need for adhesive. This is so even though it is traditionally difficult or impossible to reliably bond flexible silicone and vinyl materials with one another.

As can be seen, the use of a similar or the same curing process is highly beneficial. It permits users to custom fit the inner layer themselves simply by molding the inner layer to the desired teeth. The inner layer then cures or sets reliably bonding itself to the outer layer. This forms a very tight fitting mouthguard giving a user improved customized protection at low cost (especially as compared to a custom fit mouthguard from a dental professional). The fit is typically tight enough that the improved mouthguard will not fall from the user's teeth even when his or her mouth is open, unlike traditional custom fit mouthguards. It is noted that the bottom wall of the outer shell may be textured to provide a mechanical bond with the inner layer in some embodiments.

Figure 9:
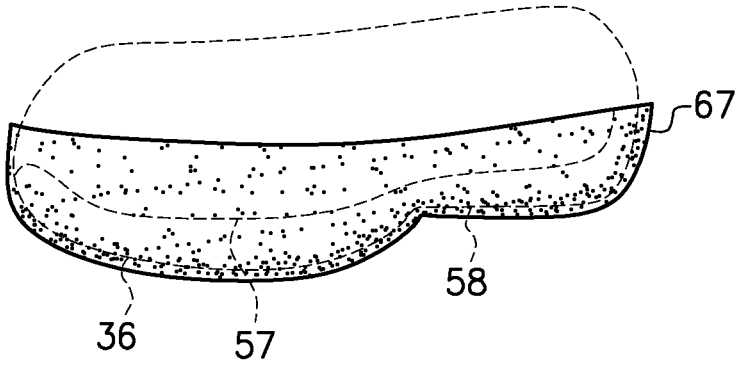
FIG. 9 is a side view of the mouthguard of this invention supported by a frame.

It is contemplated that a rigid or semi-rigid scaffold 67, such as shown in FIG. 9, may be provided to aid in the proper fitting of the improved mouthguard when the inner layer 68 is placed within the outer shell. This helps the outer shell keep its shape, especially when the inner layer is being molded to the user's teeth to form a custom fit. To illustrate, because the improved mouthguard is flexible, it has a tendency to twist or be pinched by a user when fitting the improved mouthguard. The scaffold 67 resists this twisting or pinching to help ensure that the improved mouthguard remains a proper shape.

The scaffold 67 may support the outer shell and inner layer with its rigid or semi-rigid structure. In one or more embodiments, the outer shell may fit within the scaffold 67, such as shown. The scaffold 67 may be formed from food grade thermoplastic or food tray material. The upper edge may follow the upper margin of the improved mouthguard and may extend vertically a distance up the outer periphery of the improved mouthguard. For example, as shown, the scaffold 67 extends about half the height of the improved mouthguard. The scaffold 67 is temporary and may be removed, such as after the inner layer has cured.

It can be appreciated from the above description of the construction and operation of the improved mouthguard of this invention that it possesses a number of particular advantages. It provides a pivoting action in the molar area to allow a rocking shock absorption motion of the mandible. It provides a thicker pad of soft protective shock-absorbing material in the molar-bicuspid area. It provides a construction which automatically assures a slight separation in the temporomandibular joint and which minimizes both damage to this joint and the transmission of shock waves through the joint to the brain area. The upward offset of the improved mouthguard in the anterior area minimizes stresses to the upper and lower incisor teeth, allows a freer pivotal action, thereby further minimizing potential damage, and provides for easy breathing and speaking. Finally, the improved mouthguard readily adapts itself to irregularities in the occlusion between the upper and lower jaws and the upper and lower teeth and to asymmetries of the dental arch.

It is contemplated that the improved mouthguard may be constructed from or coated with a material that distributes a flavor. This induces the production of saliva in the mouth which is highly advantageous in combating dry mouth, which can be dangerous. It is contemplated that a flavor wash may be provided to renew the flavoring provided by the mouthguard over time. In one or more embodiments, the improved mouthguard may have a surface which absorbes and subsequently releases this flavoring such as by having a plurality of miniscule or microscopic holes to store flavor therein.

It is also contemplated that the improved mouthguard may be formed from material or coated with material having antimicrobial properties to inhibit the growth of microbes, such as bacteria. This helps ensure that the improved mouthguard remains sanitary and clean. For example, it is contemplated that the improved mouthguard may include silver or other substances which inhibit microbe growth.

In addition to the above advantages, experimental results have indicated that wearing of the improved mouthguard of this invention appears to result in an increase in strength. Several individuals have found that they can press an additional amount of weight and have more endurance when wearing the improved mouthguard of this invention. This may be because setting the masseter muscle to its proper length when wearing the improved mouthguard has allowed the neuromuscular system to adapt to this improved neuromuscular position. The applicant has been told by athletes who have used the improved mouthguard of this invention that when they resumed use of conventional mouthguards, their front teeth hurt from the pressure, presumably because of the absence of the recess of the applicant's structure at the anterior portion.

While a specific form of the improved mouthguard of this invention has been illustrated and described, modifications may be made in the details of the structure without departing from the substance of the invention. For example, while specific dimensional relationships of a preferred embodiment have been set forth, these specific dimensions may be varied to some extent so long as a portion of greater thickness is provided in the molar-bicuspid area. Also while the portion of greater thickness has been disclosed as extending from the first bicuspid to the second molar, a somewhat shorter portion of greater thickness could be employed, for example not extending over the first bicuspid or over the second molar, so long as the thicker portion is provided in the molar-bicuspid region. Further, while the improved mouthguard is primarily intended for use on the upper teeth, and it is expected that it would be so used in essentially all cases, it could be adapted for use on the lower teeth if that should be necessary for a particular prospective user.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. An improved mouthguard comprising:

a bottom wall formed of a resilient material and having an approximate U-shape corresponding generally to the shape of an arch of the a first row of the user's teeth, the bottom wall having a bottom surface substantially flat laterally and being of greater width than the width a second row of the user's teeth so as to extend laterally across the full width of the second row of teeth;

a plurality of spaced inner and outer flanges extending upwardly from the bottom wall forming a cavity for receiving the first row of teeth;

a portion of greater thickness extending downward from the bottom wall across the length of each molar-bicuspid region, the portion of greater thickness being formed in an anterior-posterior direction to have an even surface curved in the anterior-posterior direction at each the molar-bicuspid region; and a plurality of adjacent openings in the bottom wall and into the portion of greater thickness but not all the way through the bottom wall and portion of greater thickness, the plurality of adjacent openings configured to absorb shock resulting from a blow to the lower jaw.

2. The improved mouthguard of claim 1 wherein each plurality of adjacent openings is arranged in a circular shape.

3. The improved mouthguard of claim 1, wherein the first row of teeth are the user's upper teeth and the second row of teeth are the user's lower teeth.

4. The improved mouthguard of claim 1, wherein the portion of greater thickness extends from the first bicuspid to the second molar.

5. The improved mouthguard of claim 1, wherein the portion of greater thickness has its maximum thickness in the area which engages the lower first molar.

6. The improved mouthguard of claim 1 further comprising padding integrally formed within a labial incisor area of the mouthguard, the padding extending approximately between a left and right cuspid.

7. The improved mouthguard of claim 1 further comprising an inner layer bonded to at least a portion the bottom wall and the plurality of spaced inner and outer flanges, the inner layer configured to conform to the shape of the teeth of the upper jaw and to enclose an open end of the plurality of adjacent openings at the top surface of the bottom wall.

8. The improved mouthguard of claim 7, wherein the inner layer and the bottom wall and inner and outer flanges are all formed using a silicon curing process to allow the inner layer to form a permanent bond to the bottom wall and the inner and outer flanges.

9. The improved mouthguard of claim 7, wherein the inner layer and the bottom wall and inner and outer flanges are all formed using a platinum silicone curing process to allow the inner layer to form a permanent bond to the bottom wall and the inner and outer flanges.

10. The mouthguard of claim 1 wherein the openings extend upward from a bottom surface of the portion of greater thickness into the bottom wall but not through an upper surface of the bottom wall.

11. The mouthguard of claim 1 wherein the mouthguard is shaped to fit over the upper or lower teeth.

12. An improved mouthguard comprising:

a bottom wall formed of a resilient material and having an approximate U-shape corresponding generally to the shape of the arch of the upper jaw, the bottom wall having a bottom surface substantially flat laterally and being of greater width than the width of the lower teeth so as to extend laterally across the full width of the lower teeth;

a plurality of spaced inner and outer flanges extending upwardly from the bottom wall forming a cavity for receiving the upper teeth;

a portion of greater thickness extending downward from the bottom wall across the length of each molar-bicuspid region, the portion of greater thickness being formed in an anterior-posterior direction to have an even surface curved in the anterior-posterior direction at each the molar-bicuspid region;

a plurality of adjacent openings extending from a top surface of the bottom wall and downward into a section of each portion of greater thickness, the plurality of adjacent openings configured to absorb shock resulting from a blow to the lower jaw; and an inner layer of resilient deformable material supported by the bottom wall and the inner and outer flanges, the inner layer configured to conform to the shape of the teeth of the upper jaw when the teeth are pressed into the inner layer and to enclose the plurality of adjacent openings at the top surface of the bottom wall, wherein the inner layer and the bottom wall and inner and outer flanges are all formed using a platinum silicone curing process to allow the inner layer to form a permanent bond to the bottom wall and the inner and outer flanges.

13. The improved mouthguard of claim 10, wherein the portion of greater thickness extends from the first bicuspid to the second molar.

14. The improved mouthguard of claim 10, wherein the portion of greater thickness has its maximum thickness in the area which engages the lower first molar.

15. The improved mouthguard of claim 10, wherein a labial incisor area has padding integrally formed therein, the padding extending approximately between a left and right cuspid of the upper jaw.

16. The improved mouthguard of claim 15, wherein the padding comprises a multi-cavity lumen extending approximately between the left and right cuspid of the upper jaw.

17. The improved mouthguard of claim 15, wherein the padding comprises an elongated foam member extending approximately between the left and right cuspid of the upper jaw.

18. The improved mouthguard of claim 12, wherein plurality of adjacent openings extends into but not through each portion of greater thickness.

19. A method of protecting the teeth and head from injury with an improved mouthguard comprising:

providing an approximately U-shaped body of resilient material having a bottom wall and spaced inner and outer flanges forming an upwardly directed cavity conforming generally to the shape of the arch of the upper jaw, the bottom wall being formed in an anterior-posterior direction to include over the length of each molar-bicuspid region a portion of greater thickness than the remainder of the bottom wall such that the bottom wall and an inner layer of deformable material are cured with a silicone curing process to ensure a permanent bond is formed between the bottom body and the inner layer of deformable;

forming one or more openings extending downward from the bottom wall and into the portion of greater thickness to increase shock absorption at the portion of greater thickness;

aligning the mouthguard with the upper jaw with the upper teeth received in the a inner layer of material within the cavity;

forming the inner layer of material to the upper teeth such that the inner layer of material holds impressions of the upper teeth therein; and closing the lower jaw until the thickened portions are engaged by the lower molar-bicuspid teeth.

20. The method of claim 19 further comprising inserting the inner layer of material into the cavity and covering an open end of the one or more openings with the inner layer of material to enclose the one or more openings.

* * * * *